United States Patent [19]

Meneely

[11] Patent Number: 4,697,558

[45] Date of Patent: Oct. 6, 1987

[54] COMPRESSION RELIEF ENGINE BRAKE

[76] Inventor: Vincent A. Meneely, 9837 McKinnon, Rural Route No. 10, Langley, British Columbia, Canada, V3A 6X5

[21] Appl. No.: 830,378

[22] Filed: Feb. 18, 1986

[51] Int. Cl.[4] ..... F02D 9/06

[52] U.S. Cl. ..... 123/321; 123/90.16

[58] Field of Search ..... 123/321, 347, 90.12, 123/90.15, 90.16

[56] References Cited

U.S. PATENT DOCUMENTS 4,398,510 8/1983 Custer ..... 123/321

4,399,787 8/1983 Cavanagh ..... 123/321

4,475,500 10/1984 Bostelman ..... 123/321

*Primary Examiner*—William A. Cuchlinski, Jr.

*Attorney, Agent, or Firm*—Seed and Berry

[57] ABSTRACT

Apparatus is disclosed for employing the compression cycle of a four-cycle internal combustion engine as means for achieving braking of a vehicle driven by said engine. The invention relates to an improved hydraulically activated relief brake utilizing an exhaust valve associated with each cylinder of the engine. An unsprung hydraulic sleeve valve is provided to advantageously maintain each exhaust valve in a slightly open position during application of the brake, thus reducing the force required to open the exhaust valve during the compression cycle of the engine.

13 Claims, 6 Drawing Figures

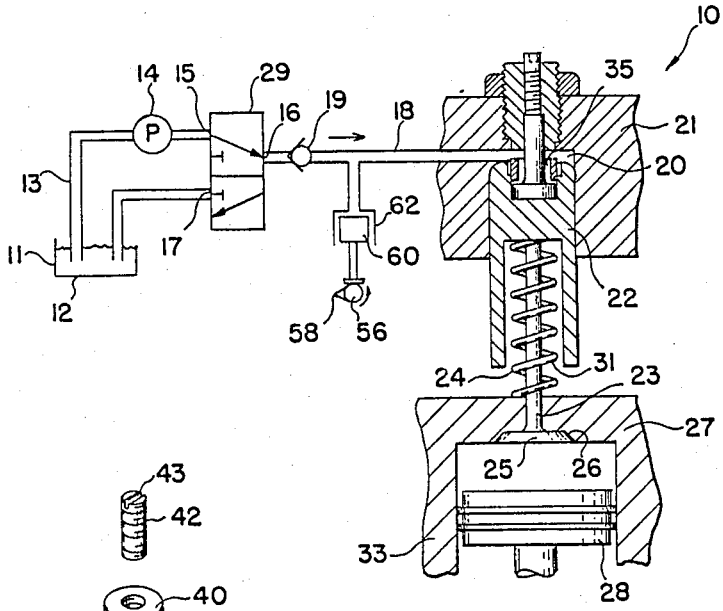
FIG. 1
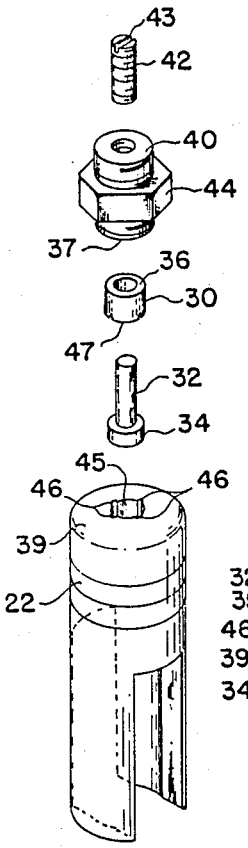
FIG. 2
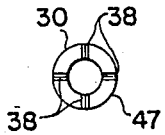
FIG. 3
FIG. 4
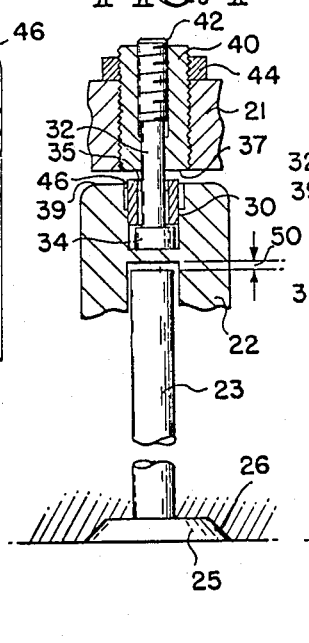
FIG. 5
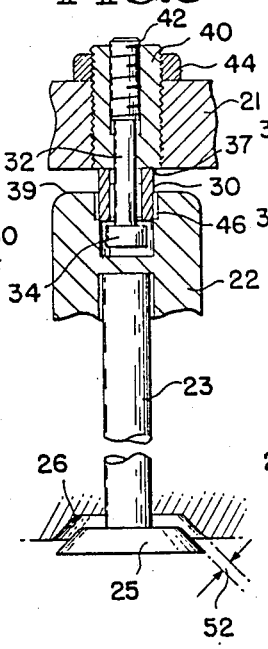
FIG. 6
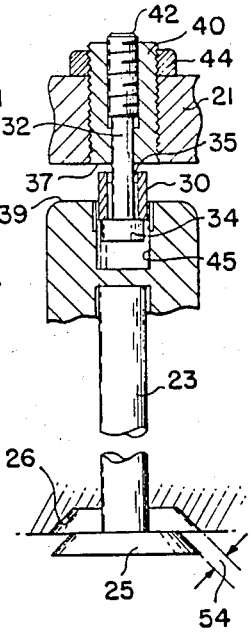

COMPRESSION RELIEF ENGINE BRAKE

DESCRIPTION

1. Technical Field

The invention relates to apparatus for employing the compression cycle of a four cycle internal combustion engine as means for achieving braking of a vehicle driven by said engine. Specifically, the invention relates to an improved hydraulically activated compression relief brake utilizing an exhaust valve associated with each cylinder of the engine, which is timed to open late in the compression cycle of the engine.

2. Background Art

A variety of apparatus has been employed to utilize the compression stroke of a four cycle internal combustion engine for vehicular braking. For instance, it is advantageous to utilize compression energy absorbed by an internal combustion engine, such as a diesel engine, to augment the friction brakes of large vehicles, especially on long downgrades. An example of such apparatus is disclosed by Custer in U.S. Pat. No. 4,398,510. Custer teaches the utilization of an exhaust valve associated with each cylinder of an internal combustion engine. The exhaust valve is hydraulically activated to open late in the compression cycle of the engine. This timed opening of the exhaust valve allows the compressed gasses within the cylinder to be dumped into the exhaust system through the prematurely opened valve thus "cheating" the engine of the power generated by the subsequent expansion stroke. Therefore, the energy requisite to achieve compression within the cylinders is supplied by the kinetic energy of the vehicle and not by the chemical energy released during the expansion cycle of the engine. Consequently as a kinetic energy of the vehicle is utilized during the application of the compression brake, the speed of the vehicle is continually reduced.

To ensure proper operation of an internal combustion engine, a minimum cold clearance is maintained between the exhaust valve and its actuating mechanism. This clearance is necessary to prevent premature opening of the exhaust valve due to thermal expansion when the engine becomes hot. This minimum cold clearance is commonly referred to as valve lash and is typically set in the range of approximately 0.004–0.024 inches. Custer teaches an anti-lash timing mechanism which takes up this cold clearance during compression brake operation to improve the timing of the opening and closing of the exhaust valve.

Custer teaches the utilization of a ball check valve to maintain hydraulic pressure within the anti-lash apparatus while the compression brake is employed. The Custer timing mechanism, however, is inordinately complex. The mechanism employs two co-axial springs, a ball check valve within an inner closely fitting piston, and a pin and associated slot to limit the degree of lash takeup. Disadvantageously the ball check valve taught by Custer can be rendered inoperative by fatigue or breaking of the spring maintaining it in a normally closed position. Additionally, the ball check valve can stick in the open position due to contaminants normally found in engine oil which is utilized in the hydraulic actuation of Custer's ball check valve.

Thus, a need exists for a different compression relief brake operating mechanism which can control the operation of the exhaust valve during brake operation with a minimum of moving parts.

3. Disclosure of Invention

It is an object of the present invention to provide hydraulically activated compression relief brake apparatus having simplified construction exemplified by having a hydraulic valve obviating the necessity for spring means to bias the position of said valve.

The invention achieves these and other objects which will become apparent in the description that follows by providing a compression relief brake for internal combustion engines comprising a pressurized oil supply and means for selectively pressurizing a hydraulic circuit with oil from said oil supply. A master piston and cylinder communicating with a slave piston and cylinder via the hydraulic circuit is also provided. An engine exhaust valve mechanically coupled to the engine and timed to open during the exhaust cycle of the engine is additionally coupled to the slave piston. The exhaust valve is spring biased in a closed state to contact a valve seat defined by the cylinder head of the engine. The slave piston defines a cavity which communicates with the hydraulic circuit. A sleeve is frictionally and slidably disposed within said cavity and when the hydraulic circuit is selectively pressurized and the engine is operating, the sleeve entraps an incompressible volume of oil within said cavity to generate a displacement of the slave piston within the slave cylinder, whereby a first gap is maintained between said exhaust valve and its associated seat. Means are provided for reciprocally activating the master piston for increasing the pressure within the previously pressurized hydraulic circuit during at least a portion of the expansion cycle of the engine whereby a second gap is reciprocally maintained between the exhaust valve and its associated valve seat.

BRIEF DESCRIPTION OF THE DRAWINGS

FIG. 1 is a schematic and diagramatic representation of a compression relief brake for internal combustion engines constructed according to the principles of the present invention.

FIG. 2 is an exploded isometric view of the slave piston and associated components.

FIG. 3 is a bottom end view of the sleeve.

FIG. 4 is a detailed cross-section depicting the relative arrangement of a portion of the components of the invention when the brake is disengaged and the exhaust valve is closed.

FIG. 5 is a detailed cross-section depicting the relative arrangement of a portion of the components of the invention when the hydraulic circuit is pressurized and the first gap of the exhaust valve is maintained.

FIG. 6 is a detailed cross-section depicting the relative arrangement of a portion of the components of the invention when the brake is engaged and during the expansion cycle of the engine wherein the second gap of the exhaust valve is reciprocally maintained.

BEST MODE FOR CARRYING OUT THE INVENTION

A compression relief brake in accordance with the present invention is generally indicated at reference numeral 10 in FIG. 1.

Referring to FIGS. 1, 2 and 3 a supply of oil 11 is maintained within an engine oil sump 12. An uptake tube 13 has one end immersed in the oil, the other end coupled to the input of an oil pump 14. The output of the oil pump is coupled to the input 15 of an electrically operated solenoid valve 29 having a selectable first output 16 and a second output 17.

In the activated state, the solenoid valve 29 permits communication between the input 15 and the first output 16 of the valve 29. A hydraulic circuit 18 comprised of hydraulic lines and fittings well known to the art is coupled to the first output 16 of the solenoid valve 29 via a check valve 19. The check valve substantially restricts flow of oil 11 in the direction of the arrow as shown in FIG. 1.

A brake housing 21 defines a slave cylinder 20 in which a closely fitting slave piston 22 is slidably disposed. A portion of the slave piston 22 extends beyond the brake housing 21. That portion of the slave piston 22 so extending from the brake housing 21 is substantially hollow defining a coaxial cylindrical first cavity 31 closed at the end which is disposed within the brake housing 21.

An internal combustion engine 33 having at least one piston 28 and associated exhaust valve 25 and intake valve (not shown) is provided. When closed, the exhaust valve 25 contacts at its periphery an exhaust valve seat 26 which is machined into a cylinder head 27.

The exhaust valve 25 has a stem 23 having one end attached to the exhaust valve 25 and the other end disposed in close proximity to the closed end of the first slave piston cavity 31. An exhaust valve spring 24, of the compression type, is disposed between the cylinder head 27 and the closed end of the cylindrical cavity 31 to bias the exhaust valve 25 in a closed position i.e., when seated in its valve seat 26.

When the engine 33 is cold, an exhaust valve clearance 50 must be maintained between the end of the valve stem 23 and the closed end of the first slave piston cavity 31. This gap 50 insures that as thermal expansion occurs and the valve expands there will be sufficient clearance to prevent such thermal expansion from restricting the valve 25 from fully closing in its seat 26 which would result in the valve being burned over a period of time by hot exhaust gases. As the engine increases in temperature the clearance 50 is reduced due to thermal expansion.

A second cylindrical slave piston cavity 45 is coaxially disposed within the slave piston 22 closed at the end adjacent to the closed end of the first cavity 31, and open at the opposite end. The bore of the second cavity 45 defines a plurality of axially disposed relief ports or grooves 46 which terminate approximately at the midpoint of the cavity 45. These ports 46 are preferably four in number, are disposed approximately 90° apart and are several thousanths of an inch deep.

A cylindrical retainer 34 is loosely disposed within the second cavity 45 and has a stem 32 extending beyond the opening of the second cavity 45 the stem 32 having a diameter less than that of the retainer 34 thus providing a shoulder which retains a cylindrical sleeve 30.

The sleeve 30 is open at both ends and its outer surface is frictionally and slidably coupled to the bore of the second cavity 45 and has an oil seal surface 36 which can be selectively mated to an oil seal surface 37 defined by a first threaded adjusting member 40 disposed within the brake housing 21. The surface 47 parallel to the oil seal surface 36 of the sleeve 30 defines a plurality of radially disposed oil relief grooves 38. These grooves are preferably four in number, are disposed approximately 90° apart and are about twenty thousandths of an inch deep and wide. The sleeve 30 has a central bore of sufficient diameter to permit the retainer stem 32 to pass therethrough without contacting the bore and creating a cylindrical oil passage 35 between the bore of the sleeve 30 and the retainer stem 32.

A lock nut 44 is provided for permanently retaining the first threaded member 40 within the brake housing 21. A second threaded adjusted member 42 is coaxially threadably engaged within the first threaded adjusting member 40. A slot 43 is conveniently provided in one end of the second threaded adjusting member 42 and the other end is attached to one end of the retainer stem 32 for convenient adjustment of the retainer 34.

During unbraked, normal engine operation, each cylinder of a typical diesel four cycle internal combustion engine is supplied an appropriate charge of fuel via a fuel injection system and air via an opened intake valve during the intake cycle of the engine. As the piston approaches top dead center during the compression cycle, following the intake cycle, the fuel air mixture is caused to ignite due to the substantially increased pressures created within the cylinder. Ignition of the fuel air mixture creates a tremendous increase in pressure within the cylinder forcing the piston downwardly during the power or expansion cycle which follows the compression cycle. Both the exhaust and intake valve are normally closed during ignition and the expansion cycle. The expansion cycle is followed by an exhaust cycle where the piston again approaches top dead center with the exhaust valve open to permit discharge of the spent gasses. At approximately top dead center the intake valve is opened and fuel is again supplied for the intake cycle.

A camshaft (not shown) having lobes appropriately disposed about its periphery is responsible for the proper timing of the opening and closing of the intake and exhaust valves. The cam shaft also drives a secondary cam shaft 56 having lobes 58 appropriately disposed about its periphery which, in turn, activates the fuel injection pump (not shown) to deliver fuel to the cylinder at the appropriate time during the intake cycle.

When the vehicle operator wishes to engage the engine brake of the present invention, he activates an electrical circuit (not shown) which in turn activates the electric solenoid valve 29. When the valve 29 is activated pressurized oil 11 from the oil sump 12 is provided by pump 14 to the input 15 of the valve 29. Such activation causes the valve 15 to be coupled to the first valve output 16 which provides pressurized oil to the hydraulic system 18 via check valve 19. Such pressurization by oil li, within the hydraulic circuit 18 causes a filling of the voids of the slave cylinder 20 with pressurized oil 11.

The oil relief grooves 38 facilitate flow of oil into the closed end of the cavity 45.

As the engine progresses through the exhaust cycle into the intake cycle, the mechanical valve actuating means (not shown) allows the exhaust valve 25 to approach its closed position. As the exhaust valve 25 approaches the closed position, the exhaust valve spring 24 urges the slave piston 22 to retract within the brake housing 21.

As the slave piston 22 so retracts, the edge of the surface 47 of the sleeve 30 defining the oil relief grooves 38 approaches the closed ends of the relief ports 46. The axially outer surface 36 of the sleeve 30 cooperatively engages the surface 37 of the first adjustable member 40, thus creating a first oil seal. Because the sleeve is frictionally disposed within the bore of the second slave valve cavity 45, significant flow of oil is not permitted past the sleeve 30 and the bore of the cavity 45 after the edge 47 of the sleeve becomes aligned with the bottom of the relief ports 46 creating a second oil seal (see FIG. 5).

When this condition occurs the sleeve entraps a volume of oil which cannot be compressed. This incompressible volume of oil overcomes the force of valve spring 24 which prevents the valve 25 from achieving a fully closed position thus maintaining a first gap 52. It is desirable to maintain a small first gap 52 continually during engagement of the engine brake so that the high compression forces ordinarily built up during the compression cycle are partially relieved facilitating further opening of the exhaust valve to its second gap 54 (preferably 0.090 inches) as shown in FIG. 6.

Opening of the valve 25 to its second gap position 54 is accomplished by providing additional hydraulic pressure within the hydraulic circuit 18 by means of a master piston 60 disposed within a master cylinder 62. The piston 60 is periodically displaced by a fuel injection pump camshaft 56 and associated cam lobes 58. The pressure generated within the hydraulic circuit 18 by the master piston 60 and cylinder 62 is sufficient to overcome the force of the exhaust valve spring 24 resulting in the valve 25 being reciprocally opened to its second gap position 54.

Opening of the exhaust valve 25 to its second gap 54 is timed to occur when the piston 28 approaches top dead center of the compression cycle, thus allowing the compressed gasses to escape at the beginning of the expansion cycle therefore cheating the engine of the power of the expansion and causing the kinetic energy of the vehicle to be utilized to compress the gasses within the cylinders. Thus, activation of the brake 10 results in converting the engine from that of a power generator to that of an air compressor which consumes power, causing the vehicle to slow down.

As the expansion cycle of the engine is completed the pressure within the hydraulic circuit 18 is allowed to decrease due to the withdrawal of the master piston 60 within the master cylinder 62 and the exhaust valve 25 is concommitantly allowed to return to the condition shown in FIG. 5 wherein the first gap between the valve 25 and its seat 26 is maintained so long as the hydraulic system 18 remains pressurized by the pump 14.

When the vehicle operator determines that the brake of the present invention no longer needs to be employed, he deactivates the electrical circuit which results in the disengagement of the pressurized oil supply from the pump 14 to the hydraulic circuit 18. The valve 29 in the deactivated state allows communication between the first output port 16 and the second output port 17 of the solenoid valve 29. This arrangement allows oil within the hydraulic circuit 18 to "bleed down" past the check valve 19 and thence drain back to the oil sump 12.

In the deactivated state, the master piston 60 has insufficient oil to pressurize the hydraulic circuit 18, thus only the mechanical means (not shown) for opening and closing the exhaust valve 25 are employed during the exhaust stroke of the engine. Moreover, due to the imperfect nature of the first and second seals, bleed down of oil entrapped within the second cavity 45 by the sleeve 30 results in an insufficient volume of oil within the second slave piston cavity 45 to maintain the first gap 52. Thus, the edge 47 of the sleeve 30 is allowed to pass beyond the closed end of the ports 46 resulting in the exhaust valve 25 being permitted to fully contact its valve seat 26 as shown in FIG. 4. In this arrangement, the valve clearance 50 may be resumed to the extent determined by the temperature of the engine.

The first threaded adjusting member 40 and second threaded adjusting member 42 provide convenient means for maintaining the proper valve clearance 50 as well as selecting the appropriate first gap 52. The first gap can be conveniently adjusted by the second threaded adjusting member 42. As the adjusting member 42 is adjusted axially, the retainer 34 is moved axially to establish an initial, unpressurized position of the piston 22. The distance between the axially inner ends of the oil relief ports 46 and the axially inner end of the sleeve 30 at the initial position determines the amount of the first gap 52. As the adjusting member 42 is moved axially inward, the retainer moves the piston axially inward, bringing the axially inner ends of the oil relief ports closer to the axially inner ends of the sleeve. Thus the gap 52 will be reduced, because the distance between which the axially inner ends of the oil relief ports can travel from the initial position to the hydraulically locked position when the axially inner ends of the oil ports become aligned with the axially inner ends of the sleeve is small. (If the retainer were set too far in, such that the axially inner ends of the oil ports were inwardly spaced from the axially inner end of the sleeve in the initial position, no gap 52 would be created, because the piston would never seal off the oil in the bore 45.) Conversely, the gap 52 will be enlarged if the adjustment screw 42 is retracted, because the retainer will be retracted. This will increase the distance between the axially inner ends of the oil relief ports 46 and the axially inner end of the sleeve in the initial position. The distance the piston will move from the initial position to the hydraulically locked position when the inner ends of the oil relief ports become aligned with the inner end of the sleeve will thus be lengthened, creating a larger gap 52. A typical first gap ranges between 0.0 and 0.050 inch (preferably 0.030 inch).

The cold lash clearance 50 is preferably adjusted when the engine is cold to a predetermined gap which generally ranges between 0.004 and 0.025 inch (preferably .018 inch), depending upon the type of engine employed. This adjustment is conveniently made after establishing the desired first gap 52, as described above. Rotating the first threaded adjusting member 40 into the brake housing 21 results in a reduction of the clearance 50. Rotating the first threaded member 40 out of the brake housing results in an increased clearance, which permits greater thermal expansion of the valve train components.

It will be appreciated that other embodiments and variations of the invention are also contemplated. For example, the apparatus can be modified within the level of one skilled in the art to be used in conjunction with engines having two exhaust valves per cylinder. Moreover, the solenoid valve can additionally provide means for quickly reducing pressure within the hydraulic circuit 18 by electrically disengaging the check valve 19 and not relying on ordinary "bleed down" of the hydraulic pressure. Thus, the scope of the invention is not to be limited by the above description, but is to be determined by the scope of the claims which follow.

I claim:

1. A compression relief brake for four cycle internal-combustion engines, comprising:

a pressurized oil supply;

means for selectively pressurizing a hydraulic circuit with oil from the oil supply;

a master piston and cylinder communicating with a slave piston and cylinder via the hydraulic circuit;

an engine exhaust valve mechanically coupled to the engine and timed to open during the exhaust cycle of the engine said exhaust valve coupled to said slave piston, said exhaust valve being spring-based in a closed state to contact a valve seat;

a sleeve frictionally and slidably disposed within a cavity defined by the slave piston which cavity communicates with the hydraulic circuit, wherein when the hydraulic circuit is selectively pressurized and the engine is operating said sleeve entraps an incompressible volume of oil within said cavity to generate a displacement of the slave piston within the slave cylinder, whereby a first gap is maintained between said exhaust valve and its associated seat; and means for reciprocally activating the master piston for increasing the pressure within the previously pressurized hydraulic circuit during at least a portion of the expansion cycle of the engine whereby a second gap is reciprocally maintained between said exhaust valve and its associated seat.

2. The compression relief brake of claim 1 wherein the pressurized oil supply comprises an oil pump wherein the supply to said pump is provided by engine lubricating oil.

3. The compression relief brake of claim 1 wherein means for selectively pressurizing the hydraulic circuit comprises an electrically activated solenoid valve.

4. The compression relief brake of claim 1 wherein the sleeve additionally comprises a first and second oil seal.

5. The compression relief brake of claim 1 additionally comprising "bleed down" means whereby the volume of oil entrapped by the sleeve within the cavity defined by the slave piston is reduced when the hyraulic circuit is not pressurized.

6. The compression relief brake of claim 1 wherein the first gap is smaller than the second gap.

7. The compression relief brake of claim 1 additionally comprising adjusting means for adjusting the first gap within a range of zero to fifty thousandths of of an inch.

8. The compression relief valve of claim 1 wherein the means for reciprocally activating the master piston comprises a camshaft mechanically linked to said master piston whereby the increased pressure generated within the previously pressurized hydraulic circuit is sufficient to maintain such second gap during the exhaust cycle of the engine.

9. The compression relief brake of claim 8 wherein the camshaft is a fuel injection pump camshaft.

10. The compression relief brake of claim 1 wherein said slave piston cavity has inner and outer ends and includes at least one axial oil relief port communicating from the outer end of the cavity a predetermined distance into the cavity, said sleeve having an inner end, the inner end of the sleeve forming a seal restricting flow of oil out of the inner end of the cavity when the inner end of the sleeve is inward of the inner end of said axial relief port, means outwardly of said cavity forming a seal seat, the outer end of said sleeve forming a seat against said seal seat to restrict flow of oil out of said cavity when said sleeve inner end is inward of the inner end of said axial relief port.

11. The compression relief brake of claim 10 where the inner end of said sleeve has at least one radial groove for providing an oil passage into said inner end of said cavity.

12. A lash adjustment mechanism for an engine having an exhaust valve comprising:

a radially outer adjusting screw having an axial bore and a radially inner adjusting screw threaded in said axial bore;

a sleeve retainer member having a retainer stem extending into said axial bore and attached to said radially inner adjusting screw, said retainer member having an inner enlarged retainer forming a sleeve seat means;

a slave piston defining a cavity having a bore, inner and outer ends and at least one axial oil relief port communicating from the outer end of the cavity a predetermined distance into the cavity;

means outwardly of said cavity forming a seal seat;

a cylindrical sleeve having a bore adapted to loosely receive said retainer stem, said sleeve frictionally coupled at its radially outer surface to the bore of said slave piston cavity, said sleeve having an inner and outer end, the inner end of the sleeve forming a first seal restricting flow of oil out of the inner end of the cavity when the inner end of the sleeve is inward of the inner end of said axial relief port, the outer end of said sleeve forming a second seal against said seal seat to restrict flow of oil out of said cavity when said sleeve inner end is inward of the inner end of said axial relief port.

13. The lash adjustment mechanism of claim 12 wherein the inner end of said sleeve has at least one radial groove for providing an oil passage into said inner end of said slave piston cavity.

* * * * *